US005186563A

United States Patent [19]

Gebhard et al.

[11] Patent Number: 5,186,563

[45] Date of Patent: Feb. 16, 1993

[54] FLUID DISPENSER WITH APPLICATOR MEMBER

[76] Inventors: Patricia A. Gebhard; Albert W. Gebhard, both of 2101 E. Alameda, Denver, Colo. 80209

[21] Appl. No.: 638,345

[22] Filed: Jan. 7, 1991

[51] Int. Cl.[5] ..... B65D 37/00

[52] U.S. Cl. ..... 401/153; 222/95; 222/214; 222/390; 222/494; 401/164; 401/169; 401/288

[58] Field of Search ..... 222/214, 494, 390, 95; 401/156, 158, 164, 153, 159, 162, 163, 169, 288

[56] References Cited

U.S. PATENT DOCUMENTS

| | | | |
|---|---|---|---|
| 1,286,875 | 12/1918 | Emerson | 222/95 X |
| 1,907,376 | 5/1933 | Weck | 222/494 X |
| 2,009,761 | 7/1935 | Calderara | 401/153 X |
| 2,058,960 | 10/1936 | Diener | 222/95 |
| 2,492,058 | 12/1949 | O'Connor | 222/214 X |
| 2,595,493 | 5/1952 | Slaby et al. | 222/214 X |
| 2,632,904 | 3/1953 | Halecky | 222/494 X |
| 3,223,289 | 12/1965 | Bouet | 222/214 X |
| 4,109,836 | 8/1978 | Falarde | 222/494 |
| 4,634,023 | 1/1987 | Tanaka et al. | 222/214 X |
| 4,775,256 | 10/1988 | Roth | 401/158 X |
| 4,958,748 | 9/1990 | Otake | 222/214 X |

FOREIGN PATENT DOCUMENTS

| | | | |
|---|---|---|---|
| 1125127 | 9/1954 | Fed. Rep. of Germany | 222/494 |
| 360908 | 10/1923 | France | 401/169 |
| 1032326 | 7/1953 | France | 401/153 |
| 480337 | 4/1953 | Italy | 222/494 |

*Primary Examiner*—Gregory L. Huson
*Attorney, Agent, or Firm*—John E. Reilly

[57] ABSTRACT

A dispenser for the application of a fluid or fluid-like material to another surface, such as, the surface of the skin is made up of an outer casing with an adjustable end cap at one end and an applicator brush at the opposite end, and a bellows-shaped container is disposed in the casing so as to be compressed by inward threaded adjustment of the end cap to discharge the material onto the applicator brush. A duckbill valve at the discharge end of the container automatically opens when a compressive force is applied to the contents within the container and, when force is no longer applied, will return to a closed position sealing off the end of the container.

8 Claims, 1 Drawing Sheet

FLUID DISPENSER WITH APPLICATOR MEMBER

This invention relates to fluid dispensing apparatus; and more particularly relates to a novel and improved combination liquid dispenser and applicator for the application of liquid materials of different viscosity to the skin.

BACKGROUND AND FIELD OF THE INVENTION

Numerous types of hand-held fluid dispensers have been devised for the application of liquid materials to the skin. For example, U.S. Pat. No. 1,865,850 to E. S. Garvey discloses a hand-held liquid dispenser with an applicator brush at one end. A spring-loaded plunger is provided with a seal at one end and a rubber end cap for depressing the plunger against the resistance of the spring in causing the material to be dispensed from a container and onto the applicator brush.

Other dispensers have been devised with a bellows-shaped container for the fluid or liquid to be dispensed and having a one-way valve at one end which is normally closed but will open under the pressure of the liquid when the container is squeezed or compressed. Representative patents are U.S. Pat. Nos. 3,355,238 to G. Schwartzman; 3,833,154 to I. J. Markowitz, 4,004,854 to C. Breer, II, 4,201,317 to H. P. Aleff, 4,220,264 to R. K. Gamadia, 4,225,061 to W. S. Blake et al, 4,397,132 to G. Pardes et al, 4,485,807 to J. L. H. Gueret and 4,903,867 to H. Mettenbrink. In general, valves of the type disclosed in those patents have fallen short in the respect that they are limited in the range of viscosity of liquid that can be effectively handled and dispensed and do not effect a positive automatic closure when pressure is no longer applied to the container so as to avoid spillage and waste of material. Also, a positive closure is important when traveling in order to prevent staining of other articles. Still another consideration is to be able to regulate the flow of many of the less viscous materials and yet achieve a positive closure to the extent of sealing the material against leakage when not in use but nevertheless to permit the closely controlled application of the desired amount of material. For example, the foregoing considerations are important in dispensing and applying liquid solutions used for the treatment of acne and which are low viscosity materials and highly flowable.

SUMMARY OF THE INVENTION

It is therefore an object of the present invention to provide for a novel and improved dispenser apparatus which is both simple and durable in construction and capable of selectively dispensing and applying a liquid material to another surface without direct contact between the user and the material being applied.

Another object of the present invention is to provide for a novel and improved dispenser and applicator apparatus which is compact, reusable and attractive in appearance and conformable for use in dispensing a wide range of different viscosity materials from light liquids, such as, water to heavy gels.

It is a further object of the present invention to provide for a novel and improved dispenser and applicator apparatus which can be hand-held and will effect positive closure of the dispenser when the liquid contents are not being dispensed; and further wherein the user is capable of closely regulating the amount of pressure needed to overcome the closure in discharging the contents as well as in relieving the pressure.

It is a still further object of the present invention to provide in a dispenser apparatus for a hand-held device which can be squeezed or compressed in such a way as to most effectively void the container of its contents; and further to provide a novel combination of a hand-held bellows-shaped compressible container and threaded end cap with pressure applying means engageable with the container to closely control the delivery of fluid contents therefrom.

In accordance with the present invention, a preferred form of dispenser is intended for the application of liquid material in which a casing is provided with an adjustable end cap at one end and an applicator member at the opposite end. A generally bellows-shaped container for the liquid material is mounted within the casing and which is compressible in a direction toward the applicator member, and valve means at one end of the container are normally urged to a closed position but yieldable to open under the pressure of material within the container when the end cap is adjusted in a direction to compress the container and cause the material to be discharged through the valve; and, when pressure is no longer applied to the material, the valve means will return to its closed position. In the preferred form, most desirably the container is centered within the casing by an axially directed portion on the container which is received within a sleeve on the end cap so that the compressive force exerted by the end cap is applied along the axis of the container. Additionally, the discharge end of the container is fixed within a central opening at one end of the casing, and the valve means is in the form of a duckbill valve having resilient sidewall portions which are biased inwardly into a closed position to normally cut off the flow of material. The duckbill valve has been found to be especially advantageous in handling low viscosity liquid materials and in effecting a sealed closure when pressure is not being applied to discharge the material from the container.

The above and other objects, advantages and features of the present invention will become more readily appreciated and understood when taken together with the following detailed description of a preferred embodiment of the present invention in conjunction with the accompanying drawings, in which:

DETAILED DESCRIPTION OF PREFERRED EMBODIMENT

Figure 1:
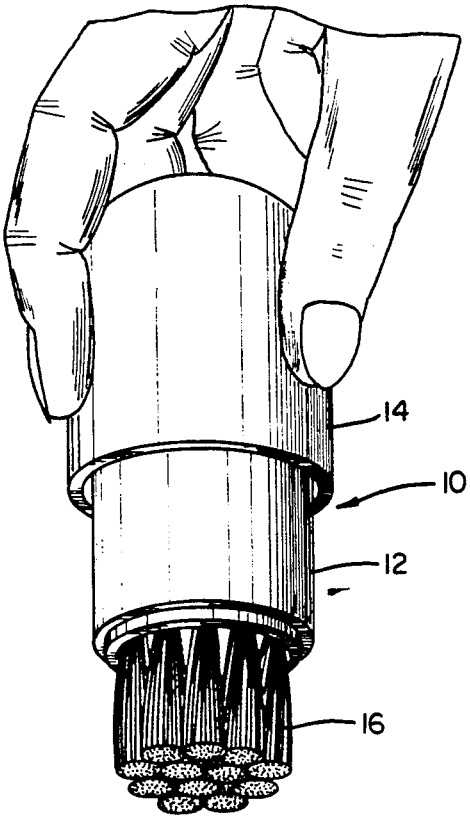
FIG. 1 is a somewhat perspective view of a preferred form of dispenser and applicator apparatus in accordance with the present invention.
Figure 4:
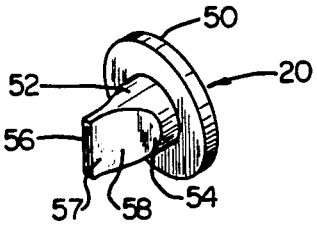
FIG. 4 is a perspective view of a preferred form of valve in accordance with the present invention.
Figure 2:
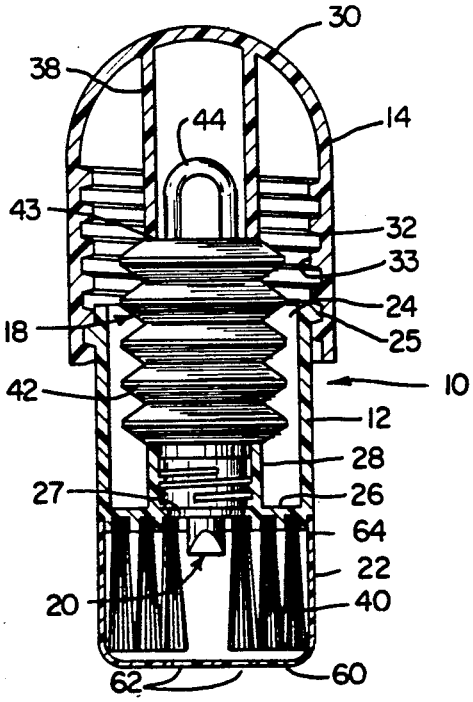
FIG. 2 is sectional view of the apparatus shown in FIG. 1 along with a brush cover removably connected to one end of the apparatus.
Figure 3:
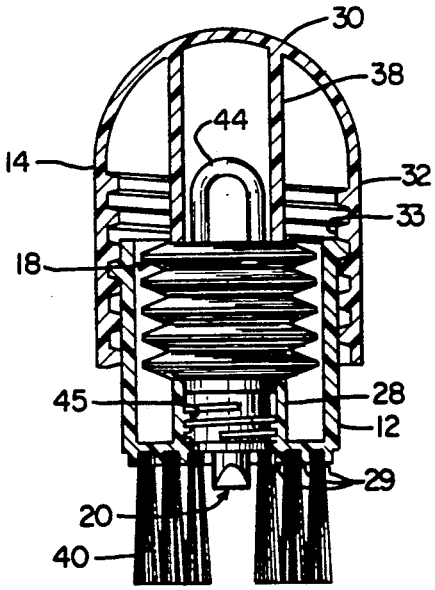
FIG. 3 is a sectional view of the apparatus shown in FIG. 1 and illustrating the application of pressure to the internal container for discharging the contents through a valve on the end of the container.

Referring to the drawings, there is illustrated in FIGS. 1 to 4 a preferred form of dispensing apparatus 10 which is broadly comprised of a hollow body in the form of a cylindrical casing 12, an end cap 14 threaded to the casing, a brush-type applicator 16 at a closed end of the casing opposite to the end cap 14, and a container 18 for fluid contents to be dispensed is disposed within the casing having a valve 20 at one end. A brush cover 22 is illustrated in FIG. 2 merely as an accessory or optional part of the apparatus to cover the brush 16 when not in use.

The preferred form of dispenser apparatus 10 is designed primarily for use in handling less viscous materials. Nevertheless, as will become hereinafter more apparent, the apparatus 10 can be used in handling a wide range of materials including more viscous lotions and cosmetics as well as selected powdered cosmetic materials.

Considering in more detail the preferred construction and arrangement of the apparatus 10, the casing 12 is made up of a thin-walled but hard plastic material and is open at one end 24 with an external thread 25 extending a limited distance around the open end to receive the end cap 14 in a manner to be described. The casing is closed at its opposite, forward end 26, except for a central opening 27 for insertion of the valve 20. An internally threaded sleeve 28 extends for a limited distance rearwardly from the opening 27 into the interior of the casing 12 to receive and support the end of the container 18, and concentric ribs 29 assist in supporting the brush 16.

The end cap 14 is also preferably a thin-walled rigid plastic member, also, having a rounded or spherical closed end 30 and a generally cylindrical wall 32 extending forwardly from the closed end which is internally threaded as at 33 to mate with the threaded portion 25 on the open end of the casing 12. The end cap is additionally provided with an axial receiving portion in the form of a hollow cylindrical member 38 which extends from the inner surface of the closed end 30 in an axial direction forwardly for a distance to approximately midway of the length of the end cap. Together, the casing 12 and end cap 14 define an enclosure for the liquid container 18 which can easily be held in the hand and manipulated to directionally compress the contents in the container but prevent any accidental squeezing or compression other than desired to dispense the liquid material.

The applicator brush 16 is of conventional construction having resilient bristles 40 permanently affixed between the ribs 29 in the closed end 26 so as to extend forwardly therefrom in surrounding relation to the central opening 27. In cosmetic applications, the bristles 40 are of course relatively soft but capable of evenly distributing a liquid material onto the area of the skin to be treated.

The preferred form of container 18 is a generally cylindrical container having a resiliently compressible outer bellows or accordionshaped wall section 42. A rear end wall 43 of the container 18 is closed and includes an axial extension 44 for insertion into the cylindrical member 38 so as to maintain the container 18 in centered relation with respect to the outer housing or casing and end cap 12 and 14, respectively. The container 18 terminates at its forward end in an externally threaded cylindrical portion 45 of reduced diameter which is sized for threaded insertion through the sleeve 28 into abutting relation to the outer surrounding edge of the closed end 26 of the casing 12. In this manner, the opposite forward and rearward ends of the container 18 are maintained on a common center or axis and which is symmetrical with respect to the outer housing. Thus, when the end cap 14 is threaded in a forward direction, the inner cylindrical member 38 will apply an axial pressure or directional compression across the rearward end wall 43 of the container to discharge its contents through the forward end. Conversely, when the end cap 14 is threaded rearwardly or backed off and away from the forward end of the casing 12, the walls of the container 18 will tend to expand or follow the rearward movement of the cylindrical member 18 thereby reducing the pressure within the container. If desired, the axially directed portion 44 of the rearward end of the container 18 can be sized to frictionally engage the inner surface of the cylindrical member 38 to a sufficient degree so as to follow its axial movement without rotating with the member 38, although generally it has been found sufficient to rely on the resiliency or memory of the bellows-shaped walls to undergo expansion when the end cap is backed off.

The valve 20 includes a flat annular flange 50 which is integrally formed in surrounding relation to an end fitting or nozzle 52, and the flange 50 secures the valve to the front end of the cylindrical member 45 and fits tightly within the opening 27. The base of the nozzle 52 is of generally hollow, cylindrical configuration but has resilient sidewalls 54 which taper forwardly from the base and are preformed to fold radially and inwardly into sealed relation to one another along a common slit or center line 56. In the normally closed position, the sides 54 are flattened against one another along leading edges 57 and curve gradually in a rearward and somewhat outward radial direction into generally concave, inwardly bowed portions 58. When pressure is applied to the container 18 to discharge liquid through the cylindrical member 38 at the front end wall, the liquid will exert pressure against the inner surfaces of the sides 54. When the pressure build-up is sufficient to overcome the inward resilient biasing of the sides, it will force the sides 54 away from one another into an outwardly bowed condition, as shown dotted in FIG. 4, thereby forming an opening for discharge of the liquid into the brush applicator section. An important feature of the valve is that when the inward threading of the end cap is stopped or the end cap is backed off even slightly, the radial inward pressure of the sides 54 will be sufficient to overcome any reduced pressure of the liquid and will fold back into the closed position.

From the foregoing, the valve 20 is preferably composed of a silicone rubber or other rubber or rubber-like material ranging in durometer between 30 and 95 shore, depending upon the viscosity of material being dispensed. The interface between the valve 20 and reduced end 38 of the container is such that the reduced end 38 simply may be threaded into abutting relation to the outer edge of the valve flange. In this way, when the contents have been fully emptied from the container 18, the end cap 14 may be removed from the casing 12 and the container 18 replaced with another full container. In the alternative, the valve may form a unitary part of the reduced end 38 of the container so as to be replaced simultaneously with the new container.

The brush cover 22 is an optional part of the assembly and actually forms no part of the present invention. As shown, it is merely a cupshaped member having a closed end 60 with one or more openings 62 for purposes of ventilation. An open cylindrical end is provided with a leading edge 64 which will frictionally engage the outermost of the upstanding ribs 29 on the forward end of the casing so as to be releasably retained in position with the brush. In addition to protecting the bristles, the cover will also serve as a stand to permit the assembly to be stored in an upright position when not in use.

It is therefore to be understood that various modifications and changes may be made in the construction and arrangement of parts comprising the preferred form of invention as herein set forth and described without departing from the spirit and scope thereof as defined by the appended claims and reasonable equivalents thereof.

We claim:

1. In a dispenser for the application of liquid material to the surface of the skin wherein an outer casing has a manually adjustable end cap at one end thereof and an applicator brush is mounted at an opposite end of said casing, the improvement comprising:

a generally bellows-shaped container for said material, said container having resilient wall portions compressible in a direction toward said brush and including an axial extension at one end; and valve means at said opposite end of said casing in communication with said material within said container, said valve means having resiliently compressible wall portions biased radially and inwardly to a closed position and yieldable to open under the pressure of said material within said container, said end cap including an axial receiving portion engageable with said axial extension, and, said end cap being manually adjustable in a direction to compress said container and cause the discharge of said material through said valve means onto said brush, and said valve means movable to a closed position under a predetermined reduction in pressure of said material within said container.

2. In a dispenser according to claim 1, wherein said end cap is threadedly adjustable on said casing to move toward and away from said opposite end of said casing, said container being resiliently compressible in an axial direction toward and away from said opposite end of said casing.

3. In a dispenser according to claim 11, said valve means having resilient arcuate wall portions diametrically opposed to one another to define a common discharge passage therebetween and normally urged in a radial inward direction against one another to close said valve means.

4. In a dispenser according to claim 1, said valve means including a flange at one end, said casing having a closed end with a central opening therein and said container having an end fitting disposed in said central opening in sealed relation to said flange on said valve means.

5. In a dispenser for the application of fluid or fluid-like material to a surface wherein an outer casing is provided, said casing having an adjustable internally threaded end cap at one end thereof and an applicator member is mounted at an opposite end of said casing, the improvement comprising:

a generally bellows-shaped container for said material disposed in said casing, said container being compressible in a direction toward said applicator member; and valve means at said opposite end of said casing in communication with said material within said container, said valve means being normally urged to a closed position and yieldable to open under the pressure of said material within said container, said end cap including an axially directed sleeve portion engageable with an end of said container opposite to said valve means and being manually adjustable in a direction to compress said container and cause the discharge of said material through said valve means onto said applicator member, and said valve means movable to a closed position upon a predetermined reduction in pressure of said material from said container, sand said container including an axial extension on said end opposite said valve means inserted in said axially directed sleeve portion of said end cap.

6. In a dispenser according to claim 5, wherein said container is resiliently compressible whereby to follow the adjustable movement of said end cap toward and away from said opposite end.

7. In a dispenser according to claim 5, said valve means having resilient wall portions diametrically opposed to one another to define a discharge passage therebetween, said wall portions normally bowed radially and inwardly against one another to close said passage, said discharge passage being in the form of a radially extending slit.

8. In a dispenser according to claim 5, said valve means including a flange at one end, and said container having an end fitting connectable in sealed relation to said sleeve on said flange means.

* * * * *